US006073997A

United States Patent [19]

Koh

[11] Patent Number: 6,073,997

[45] Date of Patent: Jun. 13, 2000

[54] FOLDABLE TABLE FOR CHAIR

[76] Inventor: Tuang Hock Koh, 95 South Bridge Road, #02-08, Pidemco Centre, 058717, Singapore

[21] Appl. No.: 09/288,144

[22] Filed: Apr. 8, 1999

[51] Int. Cl.[7] ..... A47B 39/06; A47B 83/02

[52] U.S. Cl. ..... 297/173; 297/162

[58] Field of Search ..... 297/173, 160, 297/162

[56] References Cited

U.S. PATENT DOCUMENTS

| | | | |
|---|---|---|---|
| 3,102,754 | 9/1963 | Junkunc | 297/162 |
| 3,140,894 | 7/1964 | Hicke | 297/162 |
| 3,197,253 | 7/1965 | Brown | 297/162 X |
| 3,197,254 | 7/1965 | Hendrickson | 297/162 |
| 3,265,436 | 8/1966 | La Bombard et al. | 297/162 |
| 3,269,772 | 8/1966 | Brunskole | 297/162 |
| 3,367,713 | 2/1968 | Krueger | 297/162 |
| 3,547,488 | 12/1970 | Barnes | 297/162 |
| 3,556,588 | 1/1971 | Monyer et al. | 297/162 |
| 3,586,367 | 6/1971 | Cincotta | 297/162 |
| 4,852,940 | 8/1989 | Kanigowski | 297/162 X |
| 4,944,552 | 7/1990 | Harris | 297/162 X |
| 5,087,096 | 2/1992 | Yamazaki | 297/162 X |
| 5,275,465 | 1/1994 | Gulliver et al. | 297/173 |
| 5,547,247 | 8/1996 | Dixon | 297/162 X |
| 5,564,779 | 10/1996 | Tolbert et al. | 297/173 |
| 5,653,499 | 8/1997 | Goodall | 297/173 X |
| 5,765,911 | 6/1998 | Sorenson | 297/173 |
| 5,845,964 | 12/1998 | Phoon | 297/162 |

*Primary Examiner*—Peter M. Cuomo
*Assistant Examiner*—Rodney B. White
*Attorney, Agent, or Firm*—Charles E Baxley, Esq.

[57] ABSTRACT

A foldable table includes a seat secured to a chair, a shaft pivotally secured to the seat at a pivot axle and rotatable from a horizontal position to a vertical position, and a board pivotally secured to the shaft at a pivot pin and rotatable relative to the shaft to a horizontal working position. A casing is secured to the board and includes a hub for rotatably receiving the shaft. A plate is secured to the casing and has a curved slot for receiving a fastener extended from the shaft and for limiting the rotational movement of the shaft relative to the board and the casing.

8 Claims, 4 Drawing Sheets

FOLDABLE TABLE FOR CHAIR

BACKGROUND OF THE INVENTION

1. Field of the Invention

The present invention relates to a table, and more particularly to a foldable table for a chair.

2. Description of the Prior Art

Typical chairs include a pair of arms and a table extended inward of the chair from the top of one of the arms and from the front portion of the arm. However, the table may not be folded relative to the chair such that the users may not easily enter into the seat and may not easily move out of the seat when in an emergency condition.

The present invention has arisen to mitigate and/or obviate the afore-described disadvantages of the conventional chairs.

SUMMARY OF THE INVENTION

The primary objective of the present invention is to provide a foldable table attached to a chair for allowing the table to be easily rotated to a horizontal working position and to a vertical folded and storing position.

In accordance with one aspect of the invention, there is provided a foldable table for a chair, the foldable table comprising a seat secured to the chair, a shaft pivotally secured to the seat at a pivot axle and rotatable about the pivot axle from a horizontal position to a vertical position, and a board pivotally secured to the shaft at a pivot pin and rotatable relative to the shaft about the pivot pin to a horizontal working position.

A casing is further secured to the board and includes a hub for rotatably receiving the shaft. The board includes a recess formed therein, the casing includes a peripheral wall engaged into the recess for forming a chamber between the board and the casing.

A limiting device is further provided for limiting a rotational movement of the shaft relative to the board and the casing and includes a plate secured to the casing and having a curved slot formed around the pivot pin, and a fastener secured to the shaft and slidably received in the curved slot of the plate for engaging with the plate and for limiting the rotational movement of the shaft relative to the board and the casing.

The seat includes a pair of ears extended therefrom for defining a space between the ears, the pivot axle is engaged through the ears and engaged through the space of the seat for pivotally securing the shaft to the seat.

The shaft includes an aperture formed therein, a fastener engaged in the aperture of the shaft for securing the shaft to the chair, and a lid engaged with the aperture of the shaft for shielding the fastener.

The shaft includes a first end having an extension pivotally secured to the seat at the pivot axle, the extension of the shaft includes a curved corner for allowing the shaft to rotate about the pivot axle from the horizontal position to the vertical position, and the extension of the shaft includes a flat surface for engaging with the seat and for limiting a rotational movement of the shaft relative to the pivot axle and for retaining the shaft at the vertical position.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
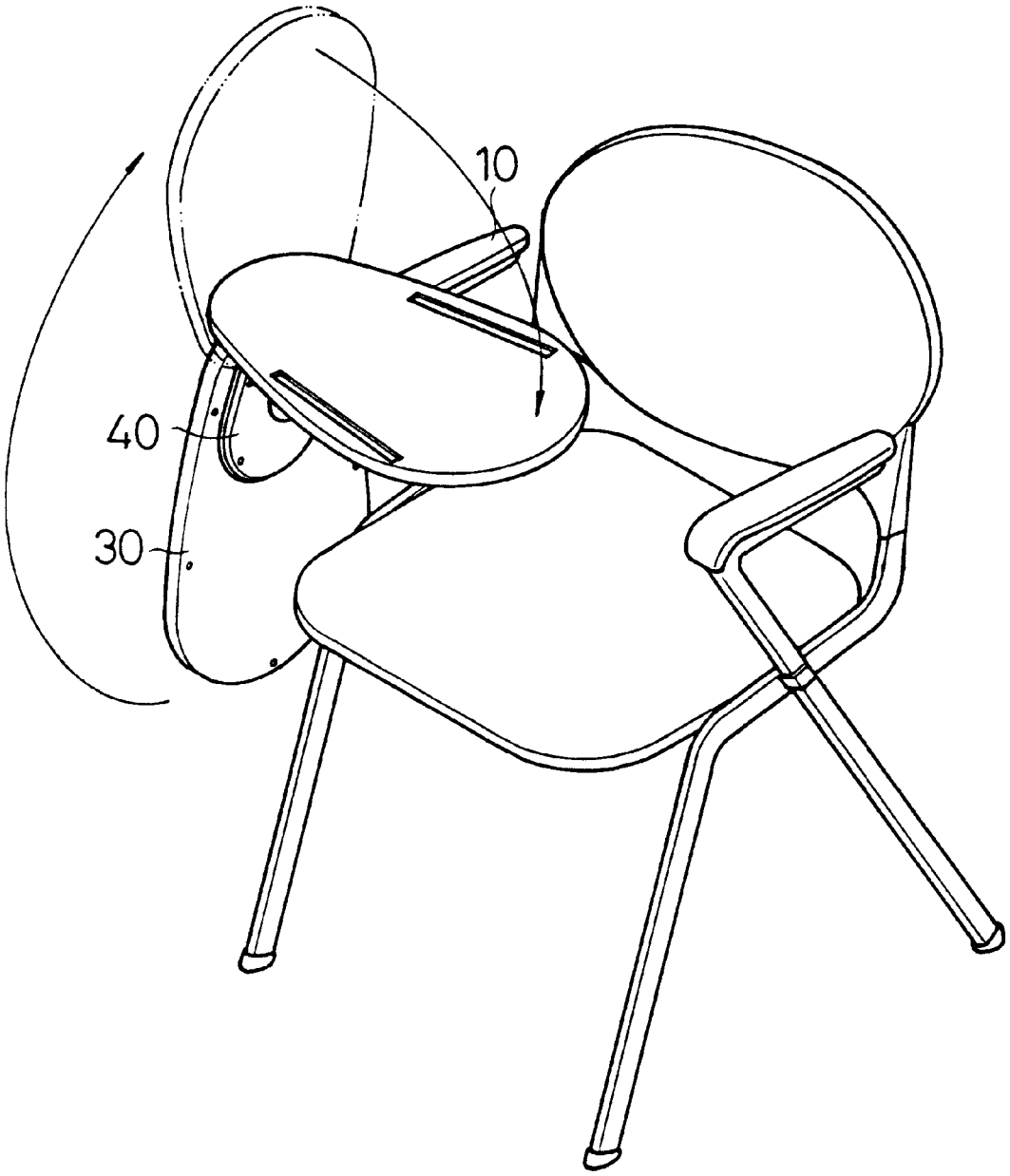
FIG 1 is a perspective view of a chair having a foldable table in accordance with the present invention
Figure 2:
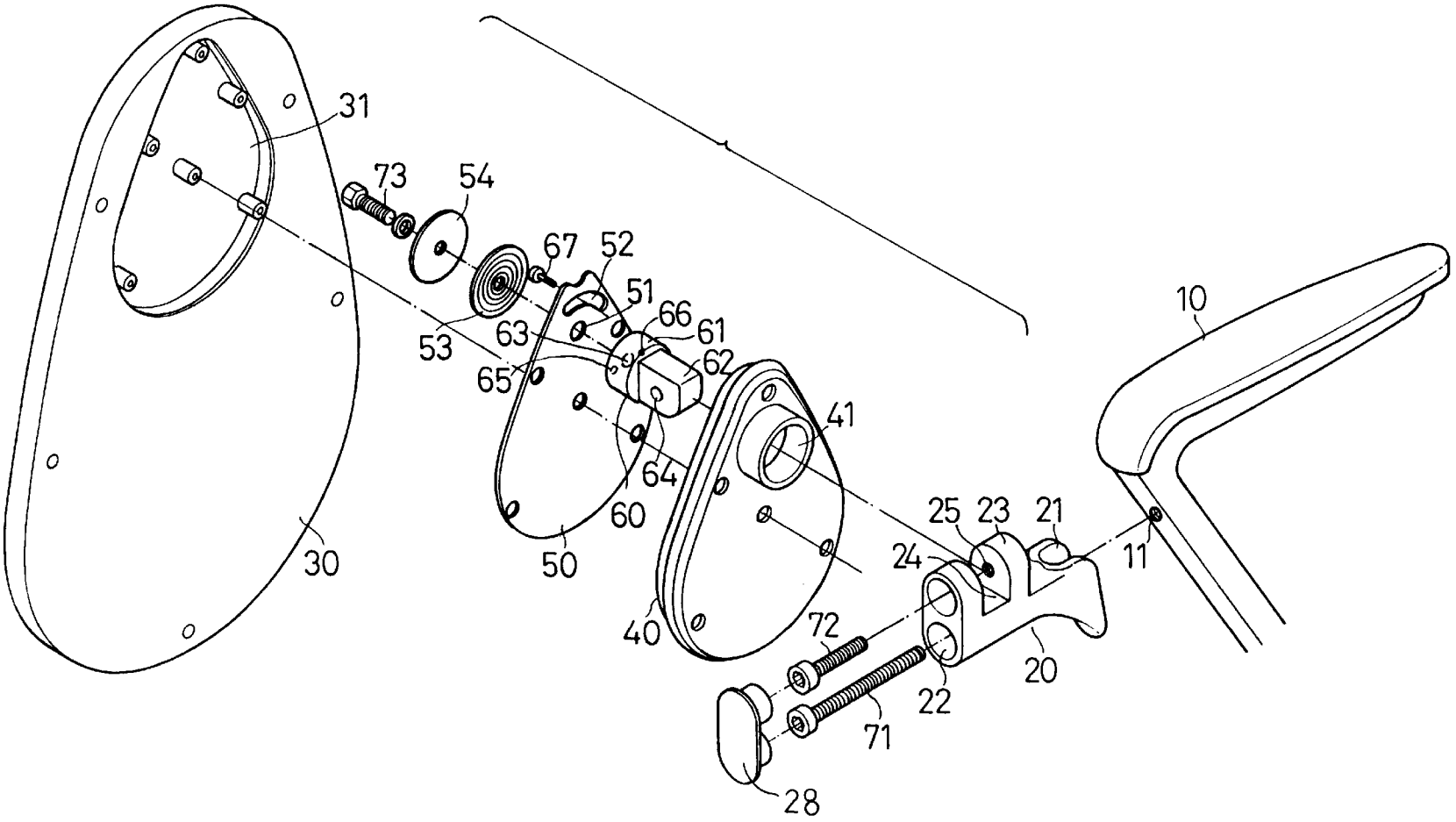
FIG. 2 is an exploded view of the foldable table.
Figure 3:
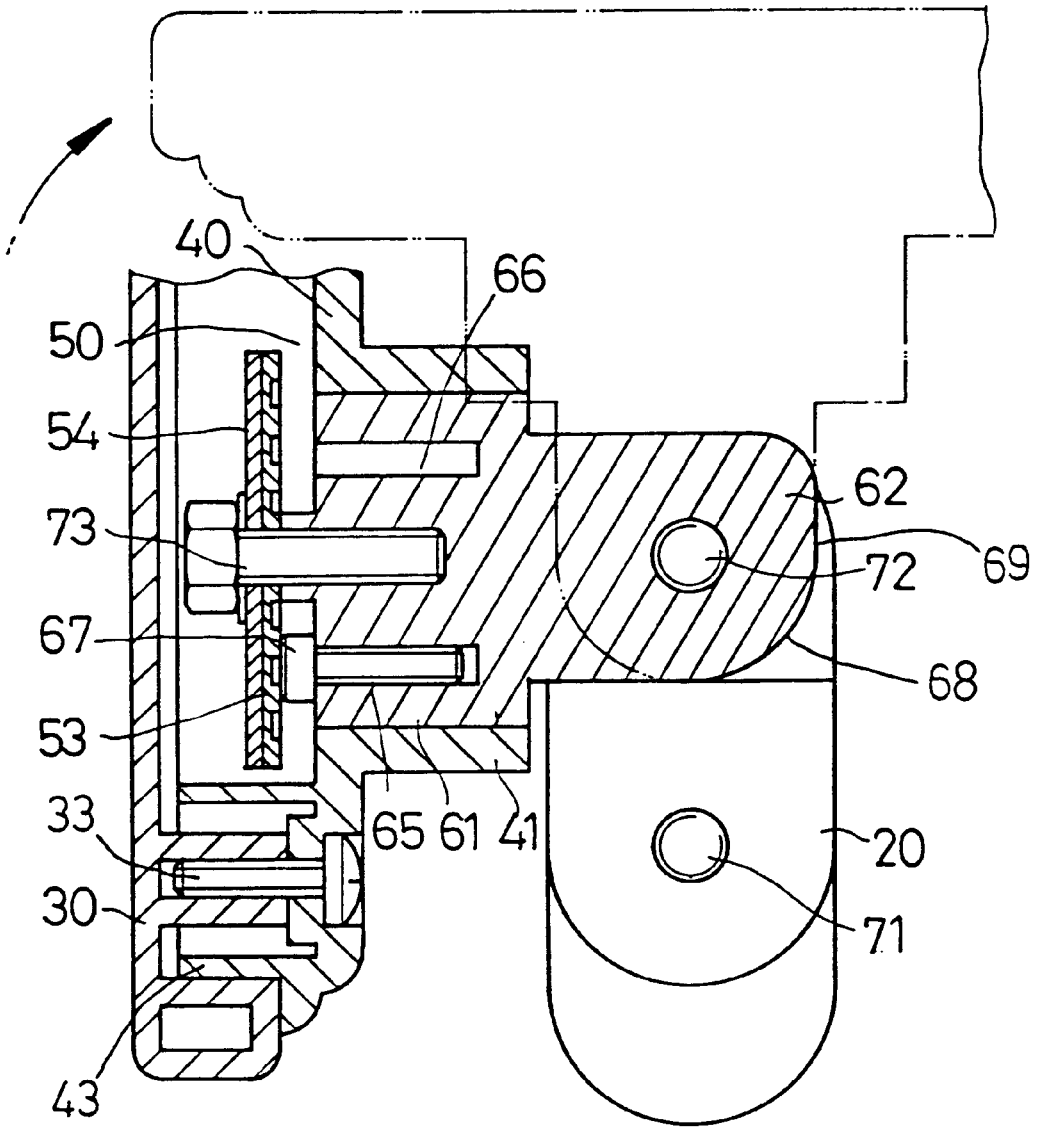
FIG. 3 is a partial cross sectional view of the foldable table.

Referring to the drawings, and initially to FIGS. 1–3, a foldable table in accordance with the present invention is designed to be attached to an object, particularly an arm 10 of a chair. A seat 20 includes a depression 21 formed in the rear portion thereof for receiving the front portion or the front beam of the chair arm 10 and includes an aperture 22 laterally formed therein for receiving a fastener 71 that is engaged with a screw hole 11 of the arm 10 for securing the seat 20 to the arm 10. The seat 20 includes a pair of ears 23 extended therefrom for defining a space 24 therebetween. Another fastener or an axle 72 is engaged with the screw holes 25 of the ears 23 and is engaged through the space 24 of the seat 10. A lid 28 is engaged with the aperture 22 for shielding the fasteners 71, 72.

A board 30 includes a recess 31 formed in the bottom portion thereof. A casing 40 includes a peripheral wall 43 (FIG. 3) engaged into the recess 31 of the board 30 and is secured to the board 30 by fasteners 33 for forming a chamber in the casing 40 or between the casing 40 and the board 30. The casing 40 includes a hub 41 for rotatably receiving a shaft 60 therein. A plate 50 is secured between the board 30 and the casing 40 by the fasteners 33 and includes an aperture 51 and a curved slot 52 formed therein, in which the curved slot 52 has a center of curvature located at the aperture 51. A pin or a fastener 73 is engaged through a cap 54 and a pad 53 of plastic steel material, and is engaged through the aperture 51 of the plate 50 and engaged with the screw hole 63 of the shaft 60 so as to rotatably secure the shaft 60 to the plate 50 and to the casing 40. The fastener 73 is formed as a pivot pin 73 for the shaft 60 to the plate 50 and the casing 40. The shaft 60 includes a cylindrical section 61 rotatably received in the hub 41 of the casing 40 and includes an extension 62 having a puncture 64 for receiving the axle 72 and for allowing the shaft 60 to be rotatably secured to the seat 20 at the pivot axle 72. The shaft 60 includes one or more orifices 65, 66 formed therein and opposite to the extension 62. A guide 67 is engaged in one of the orifices 65, 66 and is slidably received in the curved slot 52 of the plate 50 for limiting the rotational movement of the plate 50 and the casing 40 and the board 30 relative to the shaft 60 about the pivot pin 73.

When the board 30 and the seat 20 are attached to the right arm of the chair, the guide 67 is engaged in the orifice 66 of the shaft 60 for allowing the plate 50 and thus the board 30 to rotate in one direction relative to the shaft 60 to the horizontal working position as shown in FIG. 1. On the contrary, when the board 30 and the seat 20 are attached to the left arm of the chair, the guide 67 is required to be engaged in the other orifice 65 of the shaft 60 for allowing the plate 50 and thus the board 30 to be rotated in the reverse direction relative to the shaft 60 to the horizontal working position. As shown in FIG. 3, the extension 62 of the shaft 60 includes a curved corner 68 for allowing the shaft 60 to be rotated about the pivot axle 72 for about ninety degrees from the horizontal position as shown in solid lines to the vertical position as shown in dotted lines. The extension 62 includes a flat bottom 69 for engaging with the seat 20 and for limiting the rotational movement of the shaft 60 relative to the pivot axle 72 and for retaining the shaft 60 at the vertical position and for retaining the board 30 to the horizontal working position as shown in FIG. 1.

Figure 4:
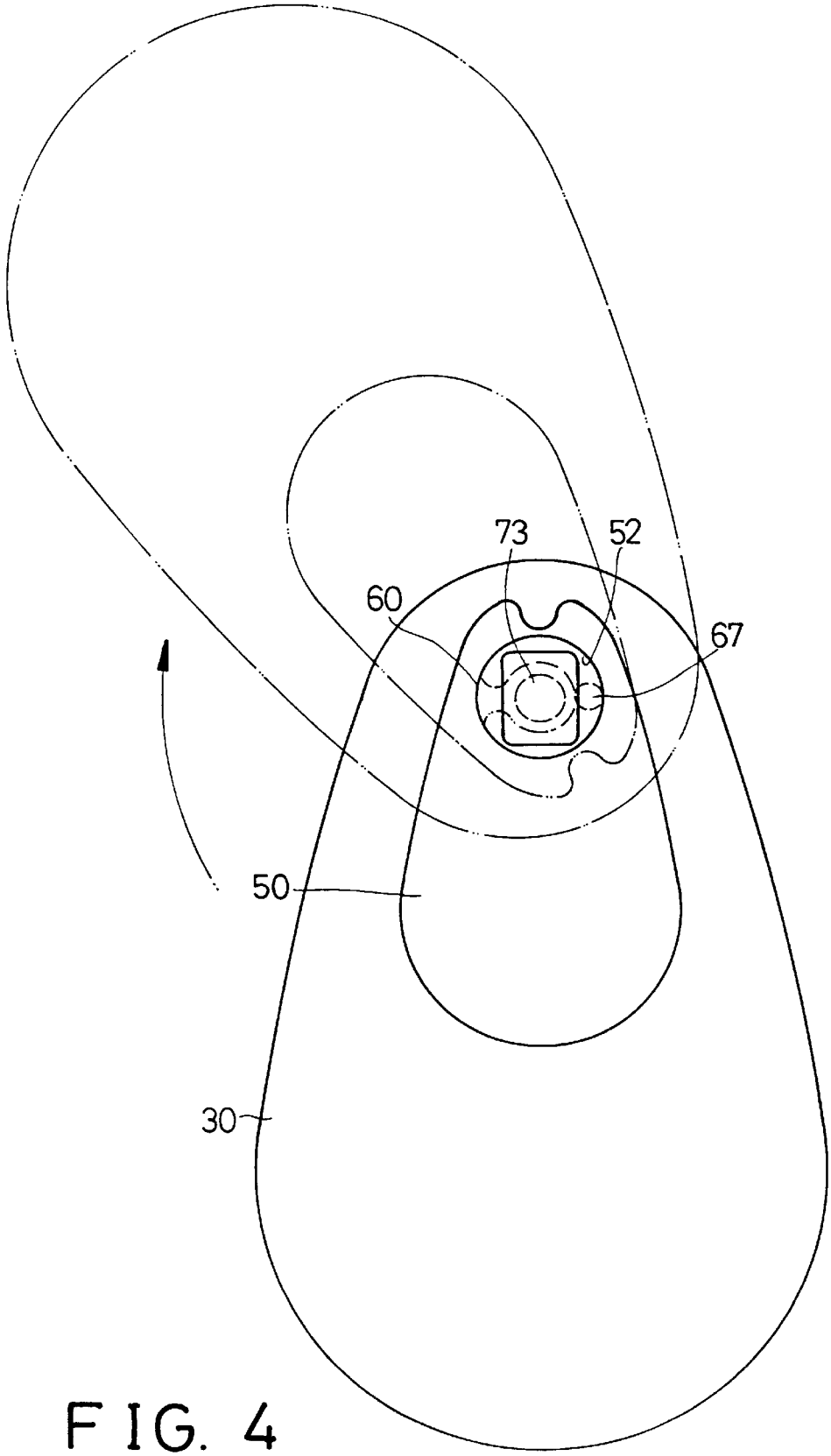
FIG. 4 is a schematic view illustrating the operation of the foldable table.

Referring next to FIG. 4, the curved slot 52 may be formed in different size and may be used for determining the rotational movement of the board 30 relative to the shaft 60.

In operation, the board 30 may be rotated from the horizontal working position to the vertical position and then rotated forward and downward to the folding position. The board 30 may also be rotated from the horizontal working position forward to a front and horizontal position and then rotated downward to the folding position. The board 30 may thus be easily folded or moved from the horizontal working position to the folding position by the legs of the user without the hands of the user such that the user may easily move outward of the chair without rotating the board 30.

Accordingly, the foldable table in accordance with the present invention may be easily rotated to a horizontal working position and to a vertical folded and storing position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair and foldable table combination comprising:

a chair, a seat secured to said chair;

a shaft pivotally secured to said seat at a pivot axle and rotatable about said pivot axle from a horizontal position to a vertical position, said shaft including an aperture formed therein, a fastener engaged in said aperture of said shaft for securing said shaft to said chair, and a lid engaged with said aperture of said shaft for shielding said fastener, and a board pivotally secured to said shaft at a pivot pin and rotatable relative to said shaft about said pivot pin to a horizontal working position when said shaft is in the vertical position.

2. The table according to claim 1 further comprising a casing secured to said board, said casing including a hub for rotatably receiving said shaft.

3. The table according to claim 2, wherein said board includes a recess formed therein, said casing includes a peripheral wall engaged into said recess for forming a chamber between said board and said casing.

4. The table according to claim 1 further comprising means for limiting a rotational movement of said shaft relative to said board and said casing.

5. The table according to claim 1, wherein said seat includes a pair of ears extended therefrom for defining a space between said ears, said pivot axle is engaged through said ears and engaged through said space of said seat for pivotally securing said shaft to said seat.

6. A chair and foldable table combination comprising:

a chair;

a seat secured to said chair;

a shaft pivotally secured to said seat at a pivot axle and rotatable about said pivot axle from a horizontal position to a vertical position, a board pivotally secured to said shaft at a pivot pin and rotatable relative to said shaft about said pivot pin to a horizontal working position when said shaft is in the vertical position, and means for limiting a rotational movement of said shaft relative to said board and said casing, said limiting means including a plate secured to said casing and having a curved slot formed around said pivot pin, and a fastener secured to said shaft and slidably received in said curved slot of said plate for engaging with said plate and for limiting the rotational movement of said shaft relative to said board and said casing.

7. The table according to claim 6, wherein said shaft includes an aperture formed therein, a fastener engaged in said aperture of said shaft for securing said shaft to the chair, and a lid engaged with said aperture of said shaft for shielding said fastener.

8. A chair and foldable table combination comprising:

a chair;

a seat secured to said chair;

a shaft pivotally secured to said seat at a pivot axle and rotatable about said pivot axle from a horizontal position to a vertical position; and a board pivotally secured to said shaft at a pivot pin and rotatable relative to said shaft about said pivot pin to a horizontal working position when said shaft is in the vertical position;

said shaft including a first end having an extension pivotally secured to said seat at said pivot axle, said extension of said shaft including a curved corner for allowing said shaft to rotate about said pivot axle from said horizontal position to said vertical position, and said extension of said shaft including a flat surface for engaging with said seat and for limiting a rotational movement of said shaft relative to said pivot axle and for retaining said shaft at said vertical position.

* * * * *